US005561933A

United States Patent [19]

Czekalski

[11] Patent Number: 5,561,933

[45] Date of Patent: Oct. 8, 1996

[54] CLIP MAGAZINE FOR USE IN FEEDING ROUNDS OF AMMUNITION TO A FIREARM

[76] Inventor: Jason A. Czekalski, 104 Thomas Rd., Rindge, N.H. 03461

[21] Appl. No.: 420,117

[22] Filed: Apr. 11, 1995

[51] Int. Cl.[6] ..... F41C 25/02

[52] U.S. Cl. ..... 42/18; 42/50

[58] Field of Search ..... 42/6, 18, 22, 49.01, 42/50

[56] References Cited

U.S. PATENT DOCUMENTS

| | | | |
|---|---|---|---|
| 506,323 | 10/1893 | Lee | 42/50 |
| 2,903,809 | 9/1959 | Stoner | 42/50 |
| 4,805,333 | 2/1989 | Doria et al. | 42/50 |
| 4,888,900 | 12/1989 | Howard | 42/50 |

FOREIGN PATENT DOCUMENTS

| | | | |
|---|---|---|---|
| 77878 | 2/1949 | Czechoslovakia | 42/50 |
| 1359028 | 3/1964 | France | 42/50 |
| 333250 | 2/1921 | Germany | 42/50 |
| 1982 | of 1882 | United Kingdom | 42/50 |
| 670564 | 4/1952 | United Kingdom | 42/22 |
| 875222 | 8/1961 | United Kingdom | 42/50 |

*Primary Examiner*—Michael J. Carone

[57] ABSTRACT

A clip magazine for use in feeding rounds of ammunition to a firearm comprising a pair of similarly configured side walls each with a rear edge, a front edge, a top edge and a tapered bottom edge, the top edge stepping downwardly toward the front edge and the bottom edge tapering upwardly from the rear edge; a front wall and a rear wall, the front wall having a projection adjacent to the top edge secured thereto adjacent to the top edges thereof, the rear wall extending from the bottom edge of the side walls adjacent to the top edge thereof and parallel with the front wall, the rear wall being wider than the front wall to form symmetric tapers from the rear wall to the front wall, the rear wall having a horizontal recess adjacent to the top walls; bottom walls at the lower edges of the side walls; a supplemental upper plate within the space between the side, front and rear walls for the positioning of rounds of ammunition thereon with a spring located between the plate and the bottom walls to urge the upper plate upwardly; and an opening in the top wall with inwardly directed lips from adjacent to the upper edges of the side walls, formed to match the rifle's existing inner feed lips, when present, or the radius of the ammunition casing, for the passage of rounds of ammunition therethrough into the chamber of a rifle to which it is coupled.

1 Claim, 4 Drawing Sheets

FIG 3
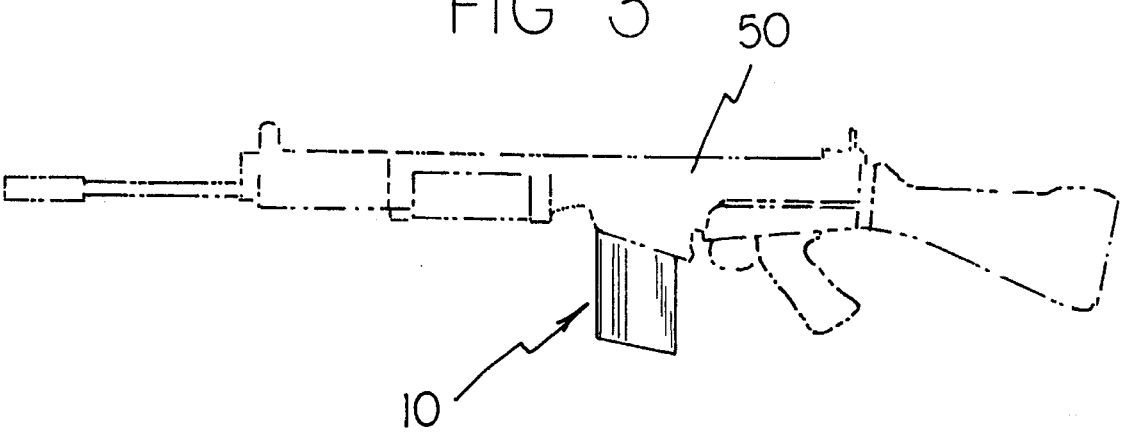
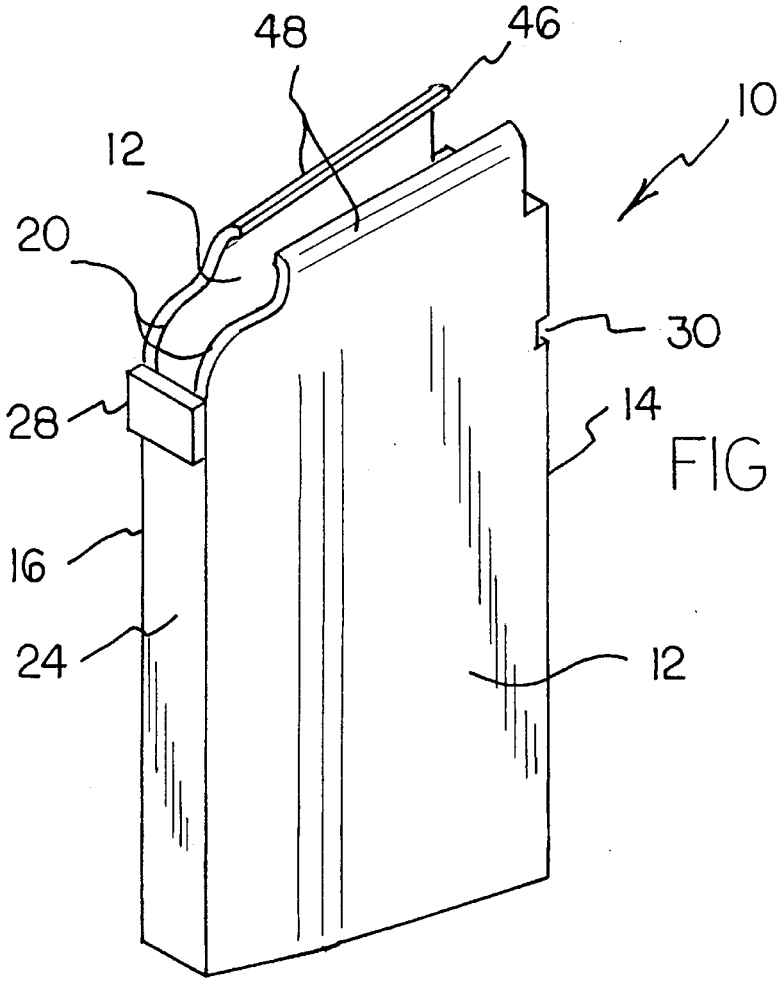
FIG 4

FIG 5
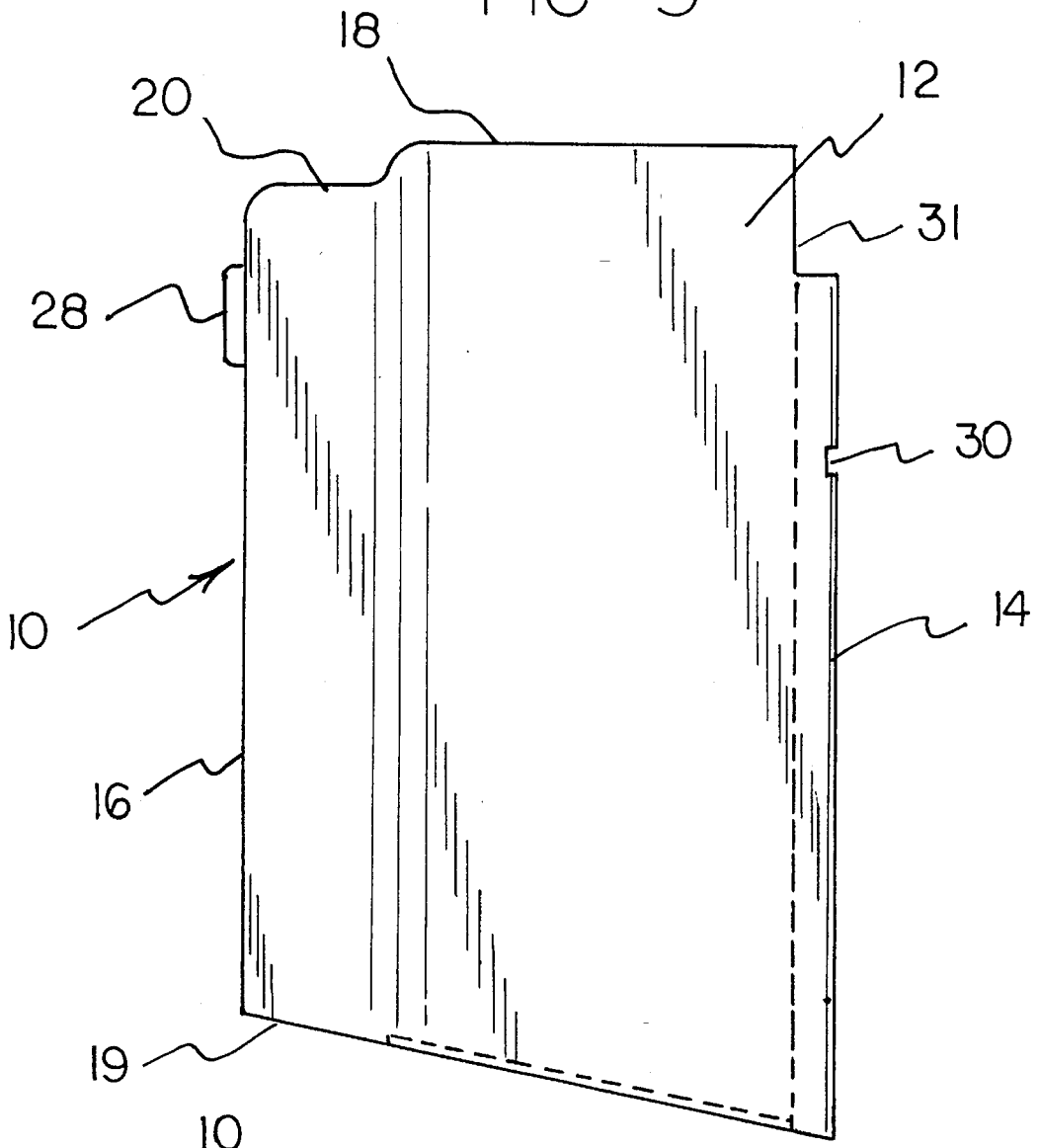
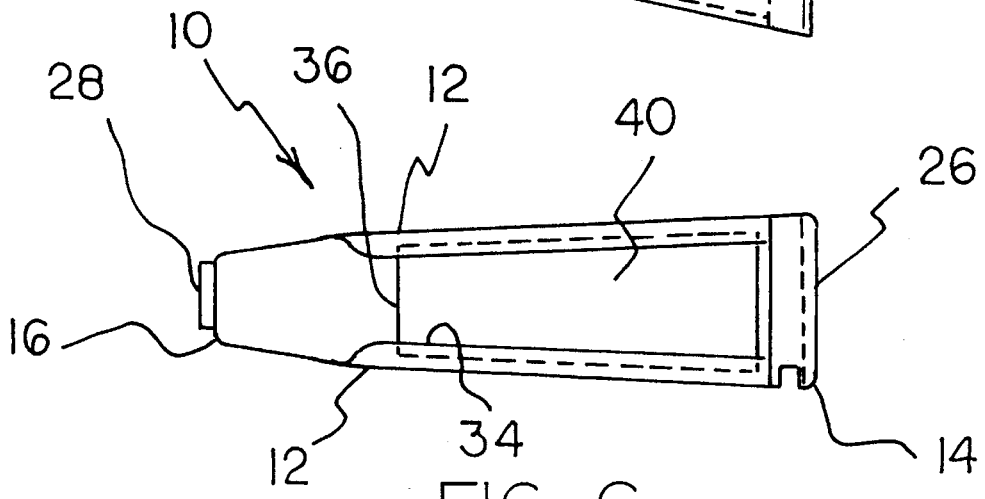
FIG 6

CLIP MAGAZINE FOR USE IN FEEDING ROUNDS OF AMMUNITION TO A FIREARM

BACKGROUND OF THE INVENTION

1. Field of the Invention

The present invention relates to a clip magazine for use in feeding rounds of ammunition to a firearm and more particularly pertains to the sequential feeding of a plurality of rounds of ammunition to the chamber of a rifle in a most efficient manner.

2. Description of the Prior Art

The use of clips for rifles and pistols of a wide variety of designs and configurations is known in the prior art. More specifically, clips for rifles and pistols of a wide variety of designs and configurations heretofore devised and utilized for the purpose of feeding rounds sequentially to the chamber of a firearm are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,509,654 a rifle magazine having transversely acting spring means therein.

U.S. Pat. No. 3,562,944 discloses a rifle with detachable magazine and latch therefor.

U.S. Pat. No. 3,977,114 discloses a rifle magazine.

U.S. Pat. No. 4,079,535 discloses a rifle adaptor assembly magazine.

U.S. Pat. No. 4,580,364 discloses a rifle cartridge magazine.

In this respect, the clip magazine for use in feeding rounds of ammunition to a firearm according to the present invention substantially departs from the conventional concepts and designs of the prior art, and in doing so provides an apparatus primarily developed for the purpose of the sequential feeding of a plurality of rounds of ammunition to the chamber of a rifle in a most efficient manner.

Therefore, it can be appreciated that there exists a continuing need for a new and improved clip magazine for use in feeding rounds of ammunition to a firearm which can be used for the sequential feeding of a plurality of rounds of ammunition to the chamber of a rifle in a most efficient manner. In this regard, the present invention substantially fulfills this need.

SUMMARY OF THE INVENTION

In view of the foregoing disadvantages inherent in the known types of clips for rifles and pistols of a wide variety of designs and configurations now present in the prior art, the present invention provides an improved clip magazine for use in feeding rounds of ammunition to a firearm. As such, the general purpose of the present invention, which will be described subsequently in greater detail, is to provide a new and improved clip magazine for use in feeding rounds of ammunition to a firearm and method which has all the advantages of the prior art and none of the disadvantages.

To attain this, the present invention essentially comprises a new and improved clip magazine for use in feeding rounds of ammunition to a rifle magazine for use in feeding rounds of ammunition to a rifle comprising, in combination, a pair of similarly configured side walls each with a rear edge, a front edge, a top edge and a tapered bottom edge, the top edge stepping downwardly toward the front edge and the bottom edge tapering upwardly from the rear edge at about fifteen degrees from the horizontal; a front wall and a rear wall, the front wall having a projection adjacent to the top edge constituting less than ten percent of the height of the side walls and secured thereto adjacent to the top edges thereof, the rear wall extending from the bottom edge of the side walls adjacent to the top edge thereof and parallel with the front wall, the rear wall being wider than the front wall to form symmetric tapers from the rear wall to the front wall at about ten degrees, the rear wall having a horizontal recess adjacent to the top walls; a pair of bottom walls formed by the inward bending of the bottom edge of the side walls with an enlarged opening therein; a supplemental upper plate within the space between the side, front and rear walls for the positioning of rounds of ammunition thereon with a spring located between the plate and the bottom walls to urge the upper plate upwardly; and an opening in the top wall with inwardly directed lips from adjacent to the upper edges of the side walls, formed to match the rifle's existing inner feed lips, when present, or the radius of the ammunition casing, for the passage of rounds of ammunition therethrough into the chamber of a rifle to which it is coupled.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved clip magazine for use in feeding rounds of ammunition to a firearm which has all the advantages of the prior art clips for rifles and pistols of a wide variety of designs and configurations and none of the disadvantages.

It is another object of the present invention to provide a new and improved clip magazine for use in feeding rounds of ammunition to a firearm which may be easily and efficiently manufactured and marketed.

It is a further object of the present invention to provide a new and improved clip magazine for use in feeding rounds of ammunition to a firearm which is of durable and reliable constructions.

An even further object of the present invention is to provide a new and improved clip magazine for use in feeding rounds of ammunition to a firearm which is susceptible of a low cost of manufacture with regard to both materials and labor, and which accordingly is then susceptible of low prices of sale to the consuming public, thereby making such clip magazine for use in feeding rounds of ammunition to a firearm economically available to the buying public.

Still yet another object of the present invention is to provide a new and improved clip magazine for use in feeding rounds of ammunition to a firearm which provides in the apparatuses and methods of the prior art some of the advantages thereof, while simultaneously overcoming some of the disadvantages normally associated therewith.

Still another object of the present invention is for the sequential feeding of a plurality of rounds of ammunition to the chamber of a rifle in a most efficient manner.

Still another object of the present invention is to provide a detachable magazine that requires no permanent modification to the rifle, for some rifles not originally equipped with a detachable magazine.

Lastly, it is an object of the present invention to provide a new and improved clip magazine for use in feeding rounds of ammunition to a firearm comprising a pair of similarly configured side walls each with a rear edge, a front edge, a top edge and a tapered bottom edge, the top edge stepping downwardly toward the front edge and the bottom edge tapering upwardly from the rear edge; a front wall and a rear wall, the front wall having a projection adjacent to the top edge secured thereto adjacent to the top edges thereof, the rear wall extending from the bottom edge of the side walls adjacent to the top edge thereof and parallel with the front wall, the rear wall being wider than the front wall to form symmetric tapers from the rear wall to the front wall, the rear wall having a horizontal recess adjacent to the top walls; bottom walls at the lower edges of the side walls; a supplemental upper plate within the space between the side, front and rear walls for the positioning of rounds of ammunition thereon with a spring located between the plate and the bottom walls to urge the upper plate upwardly; and an opening in the top wall with inwardly directed lips from adjacent to the upper edges of the side walls, formed to match the rifle's existing inner feed lips, when present, or the radius of the ammunition casing, for the passage of rounds of ammunition therethrough into the chamber of a rifle to which it is coupled.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is side elevational of the preferred embodiment of the new and improved clip magazine for use in feeding rounds of ammunition to a firearm constructed in accordance with the principles of the present invention.

FIG. 4 is perspective of the clip shown in FIG. 3.

FIG. 5 is a side elevational view of the clip shown in FIGS. 3 and 4.

FIG. 6 is a bottom elevational view of the clip shown in the prior Figures.

The same reference numerals refer to the same parts through the various Figures.

DESCRIPTION OF THE PREFERRED EMBODIMENT

Figure 1:
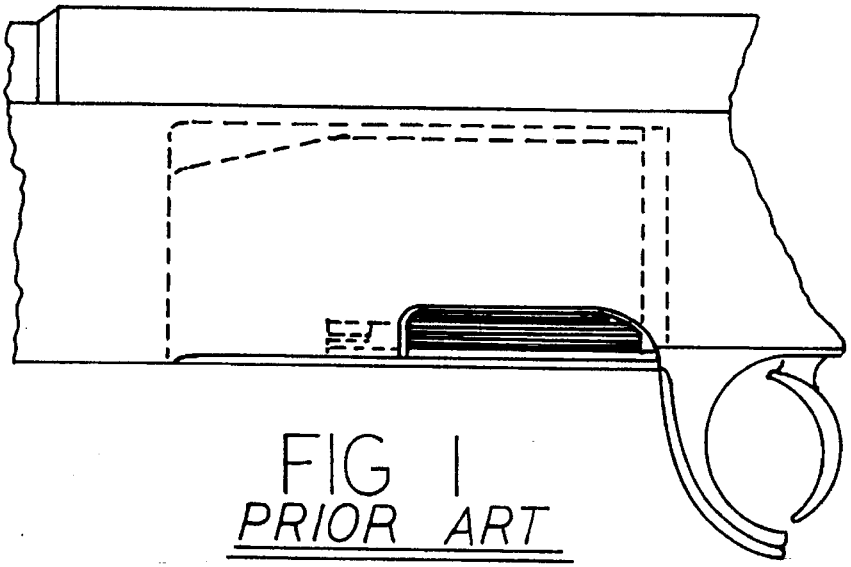
FIG 1 PRIOR ART
FIG. 1 is a side view illustrating a prior art type of magazine.
Figure 2:
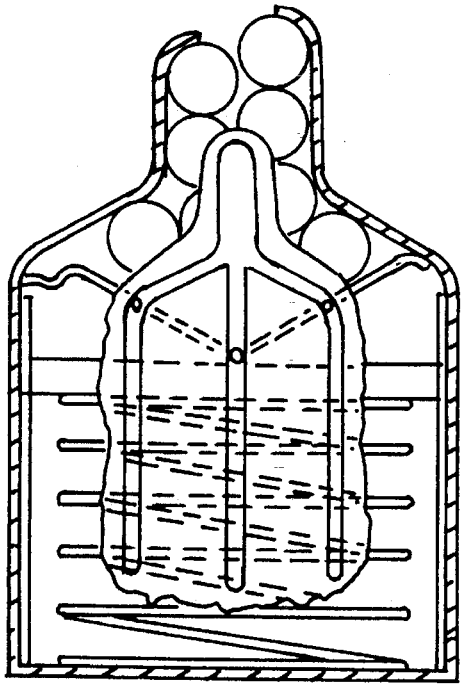
FIG 2 PRIOR ART
FIG. 2 is a cross-sectional view of a magazine for a firearm.
Figure 7:
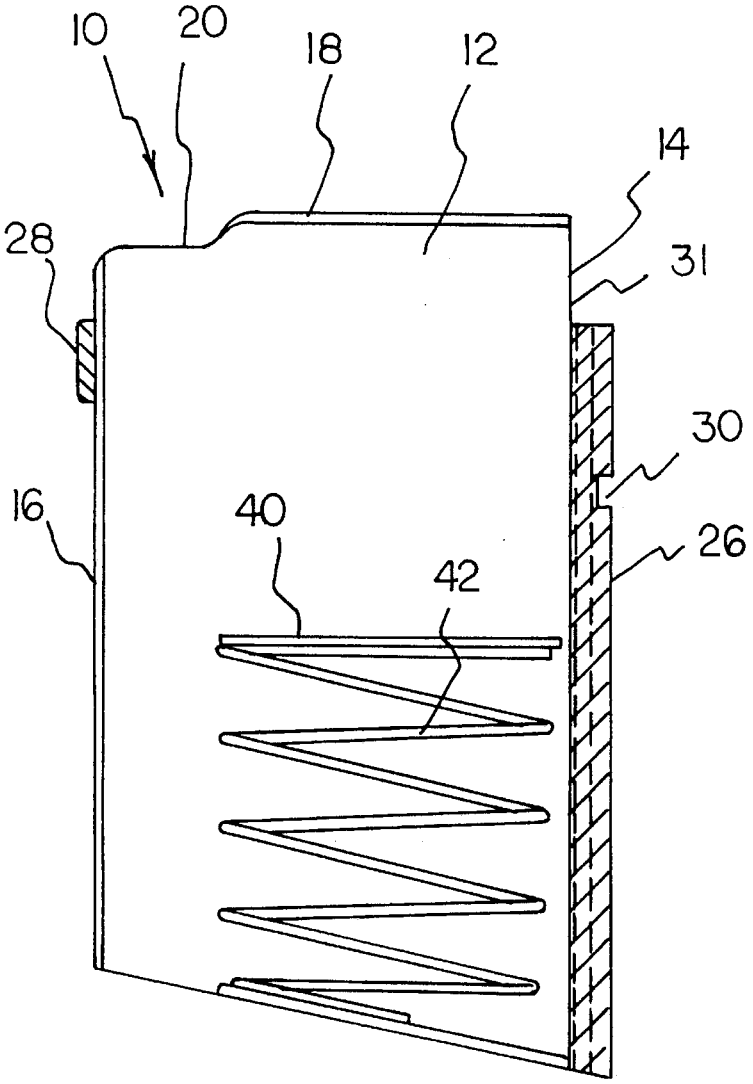
FIG. 7 is a cross-sectional taken centrally through the opposite ends of the device shown in FIGS. 3–6.
Figure 8:
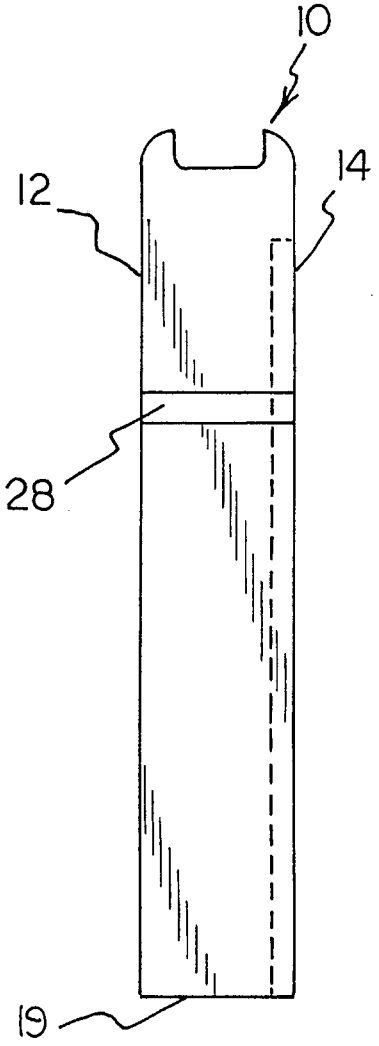
FIG. 8 is an end view of the device of FIGS. 3–6.

With reference now to the drawings, and in particular to FIG. 3 thereof, the preferred embodiment of the new and improved clip magazine for use in feeding rounds of ammunition to a firearm embodying the principles and concepts of the present invention and generally designated by the reference numeral 10 will be described.

The present invention, the new and improved clip magazine for use in feeding rounds of ammunition to a firearm, is a system comprised of a plurality of components. The components, in their broadest context, include side walls, front and rear walls, bottom walls, a supplemental upper plate, and an opening in the top wall. Such components are individually configured and correlated with respect to each other so as to attain the desired objectives.

More specifically, the central component of the clip magazine 10 of the present invention is a pair of similarly configured side walls 12. Such side walls are each formed with a rear edge 14, and a front edge 16. Such edges are vertically oriented and parallel with respect to each other. The magazine also has a top edge 18, and a tapered bottom edge 19. The top edge is formed with a step 20 which steps downwardly toward the front edge. In addition, the bottom edge tapers upwardly from the rear edge toward the front edge at an angle of about fifteen degrees from the horizontal, plus or minus about ten percent.

Next provided is a front wall 24 and a rear wall 26. Such walls are permanently secured to the opposite edges of the side walls. In addition, the front wall has a small projection 28 extending horizontally adjacent to the top edge. The elevational extent of the projection constitutes less than ten percent of the height of the side walls. It is secured to the front wall adjacent to the top edges thereof and fills the gap between the front wall and the front face of the existing magazine well. The projection is locked into the forward attachment of the previously removed floor plate fixed magazine. In addition, the rear wall extends from the bottom edge of the side walls upwardly to a region adjacent to the top edge thereof. It is parallel with the front wall. The rear wall is generally of thicker material than the front or side walls. The rear wall is stepped at the top. This step is to allow clearance between the clip and the existing inner structures of the firearm, to include but not limited to alignment lugs, bolt hold open devices, and other parts of the classic bolt action rifle. The rear wall is wider than the front wall to form symmetric tapers from the rear wall to the front wall. Note FIG. 6. Such tapers are at about ten degrees. The rear wall is also formed with a horizontal recess 30 adjacent to the top wall. Such recess has an elevational extent of less than about five percent of the height of the rear wall. The projection and the recess function together in securing the clip magazine to the bolt action rifle in which it is to be coupled.

Next provided is a bottom wall, or more accurately, a pair of bottom walls 34. Such bottom walls are formed by the inward bending of the bottom edge of the side walls. The inward bending of the side walls generates an enlarged opening 36 therein.

In addition, a supplemental upper plate 40 is provided within the space between the side, front and rear walls. Such supplemental upper plate is for the positioning of rounds of ammunition thereon. Included therewith is a spring 42 located between the plate and the bottom walls. The spring functions to urge the upper plate upwardly and, consequently, rounds of ammunition thereon upwardly for being fed into the chamber of the rifle.

Lastly provided is the opening 46. Such opening is at the top wall and includes inwardly directing lips 48 extending from adjacent to the upper edges of the side walls. These upper lips are at an elevation higher than the upper edge of the front wall and rear wall, and are formed to match the rifle's existing inner feed lips, when present, or the radius of the ammunition casing. As such, the lips will keep each round of ammunition from moving upwardly beyond the clip. Further, the lower orientation of the front wall and the rear wall will allow the movement of each round of ammunition forwardly into the chamber of the rifle 50 to which it is coupled during normal operation and use.

The present invention comprises a clip magazine which is used in older model military rifles in place of the original magazines in which each cartridge must be loaded through the top of the rifle. More specifically, the present invention has particular utility with the Belgian rifle FN Model 1949, as well as other auto-loading and bolt-action rifles that were not originally equipped with a detachable magazine. In rifles such as the FN, the rifle is hand- or clip-loaded with the magazine locked in place. The cocking handle on the right side is drawn back to unlock the action and compress the springs. Releasing the cocking handle permits the springs to drive the mechanism forward to chamber the top cartridge from the magazine and lock the bolt. A pull on the trigger fires the cartridge, and thus one shot is fired, the empty case extracted and ejected, the weapon cocked, and a new cartridge loaded into the chamber ready for firing on the next trigger pull. An individual pull is required to fire each shot on most of these weapons.

The present invention fits directly into the rifles, following the removal of the existing fixed magazine or floor plate, and although it is somewhat longer in length, requires no modifications to the weapon. It could be made in five, ten, and even twenty round sizes, with a block to modify them to hold only five, for hunting in states which have such limits. Typically, the clip would be approximately 5¾ inches long, 3½ inches wide and one inch in thickness, and made of steel with tempered steel springs. The feed lips and tapered shape match the opening in the receiver, and grooves and ears fit on the bolt stop plunger and the release lever.

The present invention can be simply slipped into an existing rifle to obtain all of the benefits of such equipment. It not only eliminates the loading of the cartridges through the top of the rifle, but also does not require that each round is cycled through the action for removal, which is a very dangerous practice.

It is a common practice to permanently alter such rifles to allow them to accept a clip. This makes them non-standard equipment which is illegal in some states. This new clip fits directly into the rifle which makes it much more practical and should gain rapid acceptance.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. A new and improved detachable clip magazine for use in feeding rounds of ammunition to a rifle not previously designed for such a clip magazine comprising, in combination:

a pair of similarly configured side walls each with a rear edge, a front edge, a top edge and a tapered bottom edge, the top edge stepping downwardly toward the front edge and the bottom edge tapering upwardly from the rear edge at about fifteen degrees from the horizontal;

a front wall and a rear wall, the front wall having a projection adjacent the top edge and extending horizontally across the front wall, the projection constituting less than ten percent of the height of the side walls and secured thereto, the rear wall extending from the bottom edge of the side walls adjacent to the top edge thereof and parallel with the front wall, the rear wall being wider than the front wall to form symmetric tapers from the rear wall to the front wall at about ten degrees, the rear wall having a horizontal recess adjacent to a top wall, the horizontal recess having an elevational extent of less than about five percent of the height of the rear wall, the projection of the front wall and the recess of the rear wall capable of functioning together for securing a clip magazine to a bolt action rifle;

a pair of bottom walls formed by the inward bending of the bottom edge of the side walls with an enlarged opening therein;

a supplemental upper plate within the space between the side, front and rear walls for the positioning of rounds of ammunition thereon with a spring located between the plate and the bottom walls to urge the upper plate upwardly for feeding the ammunition into the rifle; and an opening in the top wall with inwardly directed lips from adjacent to the upper edges of the side walls, the lips being at an elevation higher than an upper edge of the front and rear walls, the lips being formed to match the rifle's existing inner feed lips, when present, or the radius of the ammunition casing, for the passage of rounds of ammunition therethrough into the chamber of a rifle to which it is coupled.

* * * * *